United States Patent [19]

Du Corday

[11] Patent Number: 4,681,232

[45] Date of Patent: Jul. 21, 1987

[54] PERIODICAL HANGING SYSTEM AND APPARATUS

[76] Inventor: Gerard M. Du Corday, 10871 Thorley Rd., Santa Ana, Calif. 92705

[21] Appl. No.: 674,288

[22] Filed: Nov. 23, 1984

[51] Int. Cl.[4] ..... A47F 5/00

[52] U.S. Cl. ..... 211/46; 248/340; 281/46

[58] Field of Search ..... 211/45, 46, 113; 248/339, 340, 316.5; 281/15 A, 46

[56] References Cited

U.S. PATENT DOCUMENTS

| | | | |
|---|---|---|---|
| 789,065 | 5/1905 | Reuter | 281/46 |
| 1,004,802 | 10/1911 | Martin | 281/46 |
| 3,174,626 | 2/1965 | West | 281/15 A |
| 4,132,316 | 1/1979 | Schmidt | 248/340 X |

*Primary Examiner*—Robert W. Gibson, Jr.
*Attorney, Agent, or Firm*—Gausewitz, Carr & Rothenberg

[57] ABSTRACT

A hanger for books and periodicals, such as magazines and journals, has first and second elongated hanger members that extend respectively along inside and outside portions of the periodical spine to clamp the periodical spine between the hanger members. The members are fixed to one another at one end and either fixedly or detachably connected to one another at the other end. A hook or other suspension device is connected to the upper end of the hanger to enable a number of magazines to be stored and displayed by being suspended from a single point on a hook or horizontal support rod, with each periodical being held by the full length of its spine and suspended at a single one of its upper corners.

30 Claims, 32 Drawing Figures

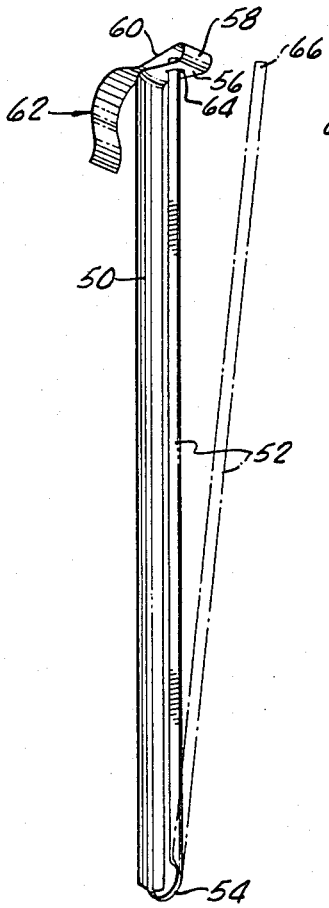
FIG. 4.
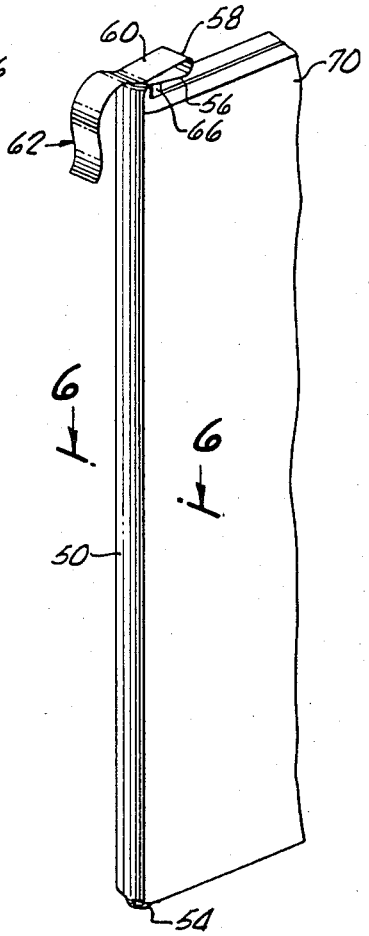
FIG. 5.
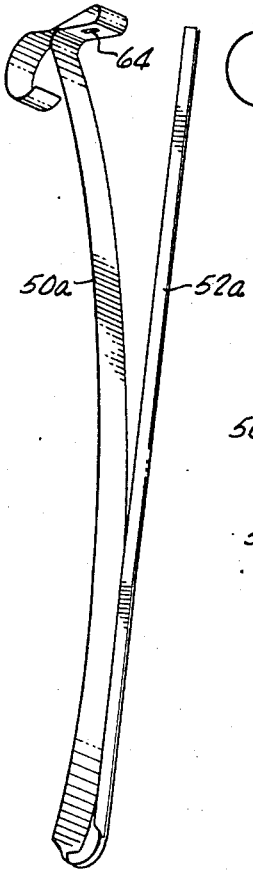
FIG. 7.
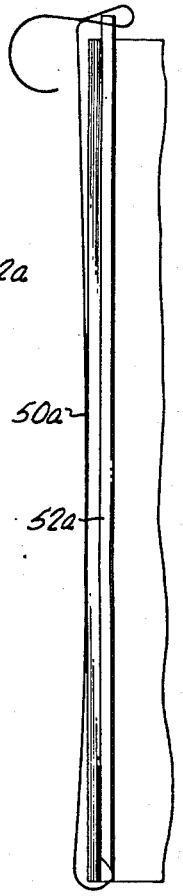
FIG. 8.
FIG. 10.
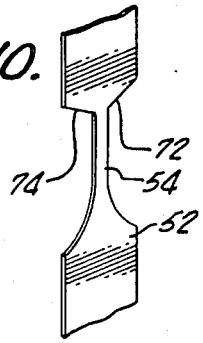
FIG. 6.
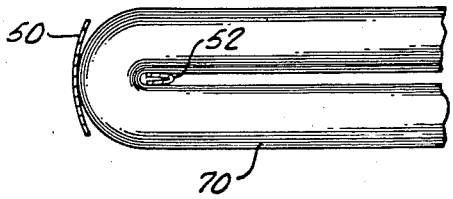
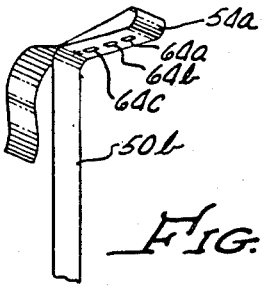
FIG. 9.
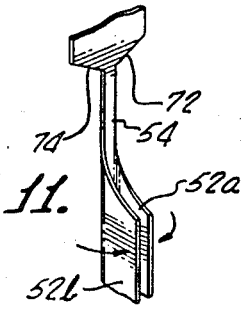
FIG. 11.

FIG. 12.
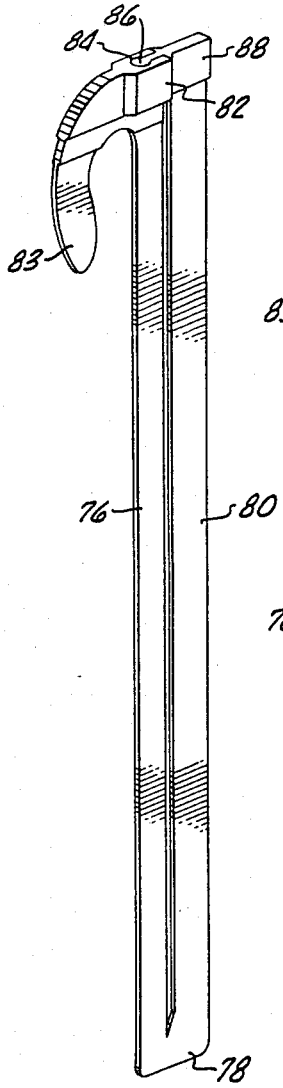
FIG. 13.
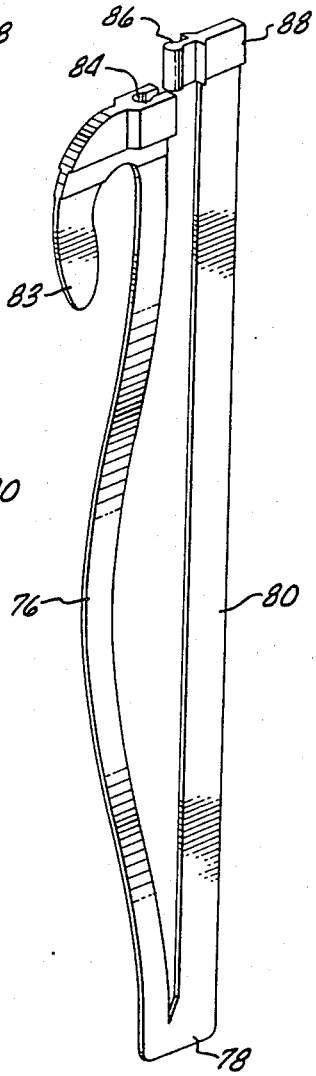
FIG. 14.
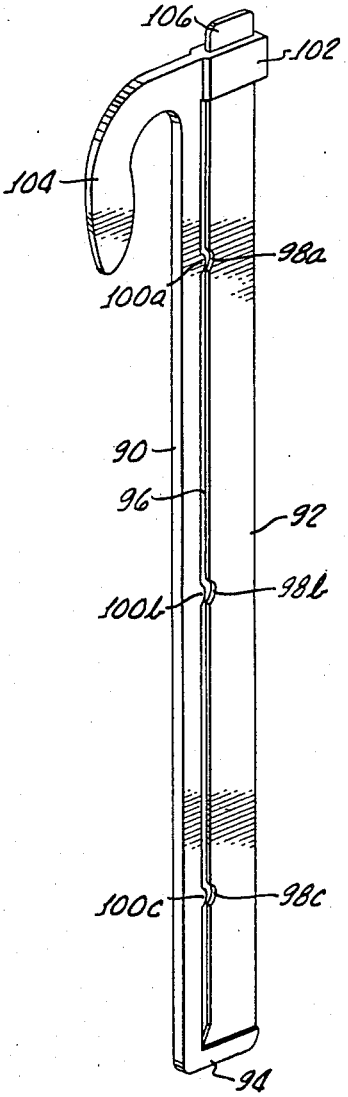
FIG. 15.
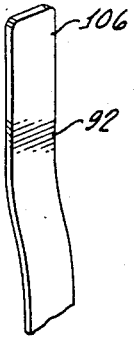
FIG. 16.
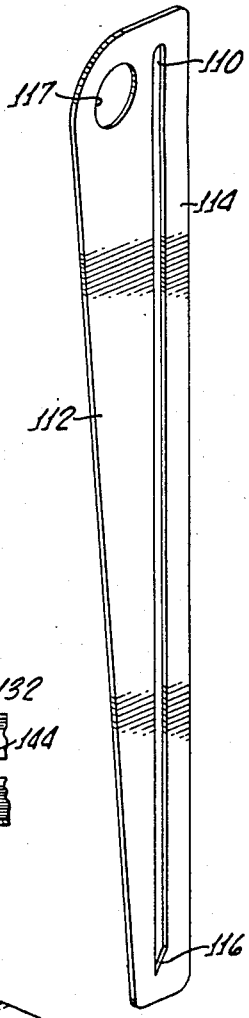
FIG. 17.
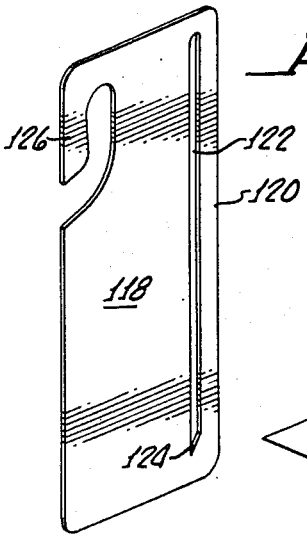
FIG. 19.
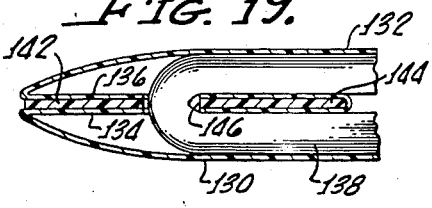
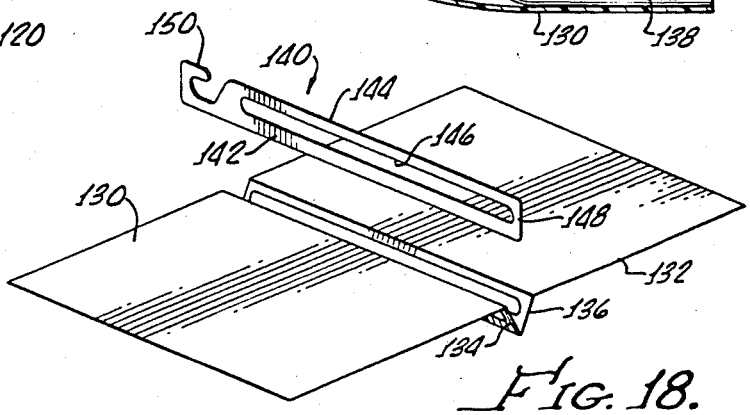
FIG. 18.

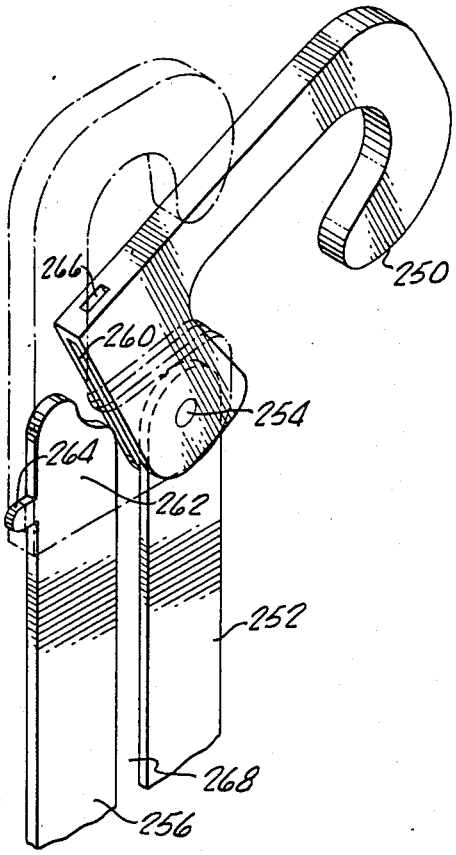
FIG. 26.
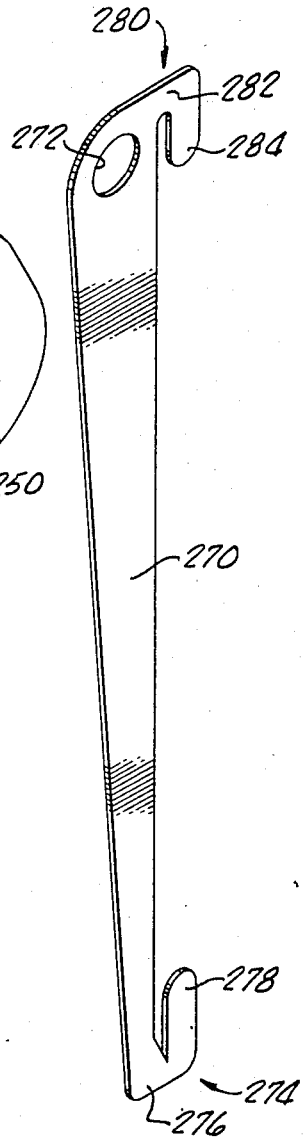
FIG. 27.
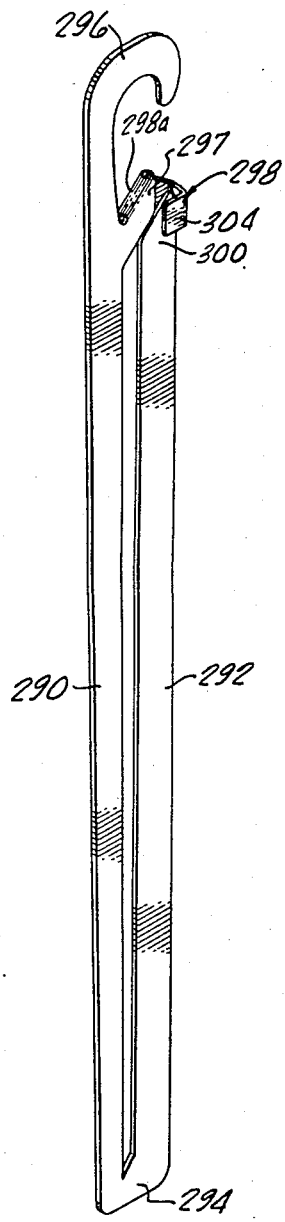
FIG. 28.
FIG. 29.
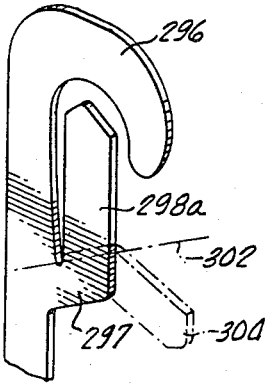
FIG. 30.
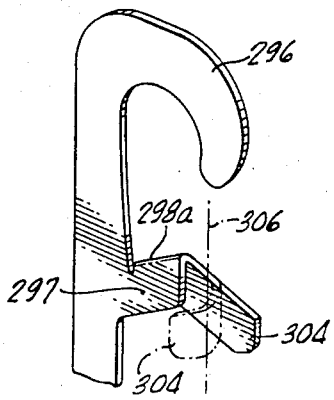

PERIODICAL HANGING SYSTEM AND APPARATUS

BACKGROUND OF THE INVENTION

The present invention relates to systems, methods, and apparatus for storing and displaying books, magazines, journals, and other periodicals, and more particularly concerns such systems, method, and apparatus for accomplishing such storage in a minimum space while still retaining a significant degree of visual access.

Storage of books in a library or bookstore is accomplished by positioning the books in substantially vertical orientation upon book shelves and in immediately adjacent side-by-side relation. Because of the width of the book, title and other information are readily printed on the spine of the book (the binding), so that the book may be readily identified merely by visually scanning the prominently displayed book backs.

In periodicals, such as magazines, journals, pamphlets, and the like, the method of binding and the nature of the periodical itself generally prevent the printing of identifying indicia on the spine of the periodical, so that if the periodicals are stored on shelves in the manner of storage of books, there is no visual access to the periodicals, and it becomes difficult or impossible to distinguish one from another without removing one from the shelf. For this reason, it is common to display periodicals in different types of shelving, which include horizontally extending, but vertically inclined supports for periodicals which are laid on their side in edge to edge relation with front covers facing the viewer. The periodicals may be overlapped, one upon another, to some extent, but they cannot completely overlap because enough of the cover of each periodical must be clearly visible for display of at least the periodical title. This practice requires the use of significantly larger amounts of floor space and supporting equipment.

In libraries, bookstores, and the like, the unit cost of maintaining a periodical section is substantially higher than the similar cost for the average book section, primarily because of the disproportionately greater amount of shelving space and floor space required to display a magazine, as compared with that required for display of books. For example, in order to properly display 300 periodicals, a library may invest as much as $10,000 in twelve five-tier display units having inclined shelves, which units require up to 45 square feet of floor and wall space. Twelve comparably sized book shelves, on the other hand, are capable of holding and displaying six to ten times as many books. Thus, it is clear that present methods and systems for display of periodicals, and the like, in libraries, schools, bookstores, and other similar institutions, impose excessively great expenses in the form of the enormous amount of floor space required and the high cost of the necessary shelving.

Accordingly, it is an object of the present invention to provide for the storage and display of periodicals, such as magazines, journals, and the like, by means of more compact, simpler, and inexpensive arrangements which will permit ready access for browsing, selection, removal, and replacement by the users.

SUMMARY OF THE INVENTION

In carring out principles of the present invention in accordance with a preferred embodiment thereof, an elongated hanger member is positioned to extend along the spine of a periodical, with its ends adjacent the top and bottom of the periodical spine. Elements connected with the top and bottom of a hanger member support retain the spine (and therefore the periodical) upon the hanger member. A suspension device at one end of the hanger member will thus support the periodical from a single upper corner and may be hooked over or otherwise supported from a periodical support, such as a substantially horizontally extending support bar. Thus, a large number of periodicals may be hung in substantially vertical orientation in close side-by-side relation, and yet any single one may be readily pivoted out of its position within the periodicals of a group, and, being loosely and freely suspended, may be successively displaced one at a time by the reader to enable him to read the title and thus identify a particular periodical. Individual periodicals that are selected may be readily removed from the group or replaced therein.

BRIEF DESCRIPTION OF THE DRAWINGS

FIGS. 4 and 5 illustrate one form of periodical hanger embodying principles of the present invention;

FIG. 6 is a section taken on lines 6—6 of FIG. 5;

FIGS. 7 and 8 illustrate a modification of the embodiment of FIGS. 4, 5, and 6;

FIG. 9 shows another modification of the design of FIGS. 4–8;

FIGS. 10 and 11 illustrate details of the construction of the embodiments of FIGS. 4–8;

FIGS. 12, 13, and 14 illustrate embodiments of a periodical hanger having modified latching;

FIG. 15 shows details of a portion of the hanger of FIG. 14;

FIGS. 16 and 17 show two other embodiments having an integral construction;

FIG. 18 is an exploded view of the outside of a protective periodical cover having a hanger embodying principles of the present invention incorporated therein;

FIG. 19 is a fragmentary sectional view of a periodical covered with the cover and hanger of FIG. 18;

FIG. 26 shows a hanger having a pivoted hook;

FIG. 27 illustrates an integral hanger of simplified construction;

FIG. 28 shows a further modification;

FIGS. 29 and 30 show the hanger of FIG. 28 in successive stages of its fabrication;

DETAILED DESCRIPTION OF THE INVENTION

Figure 1:
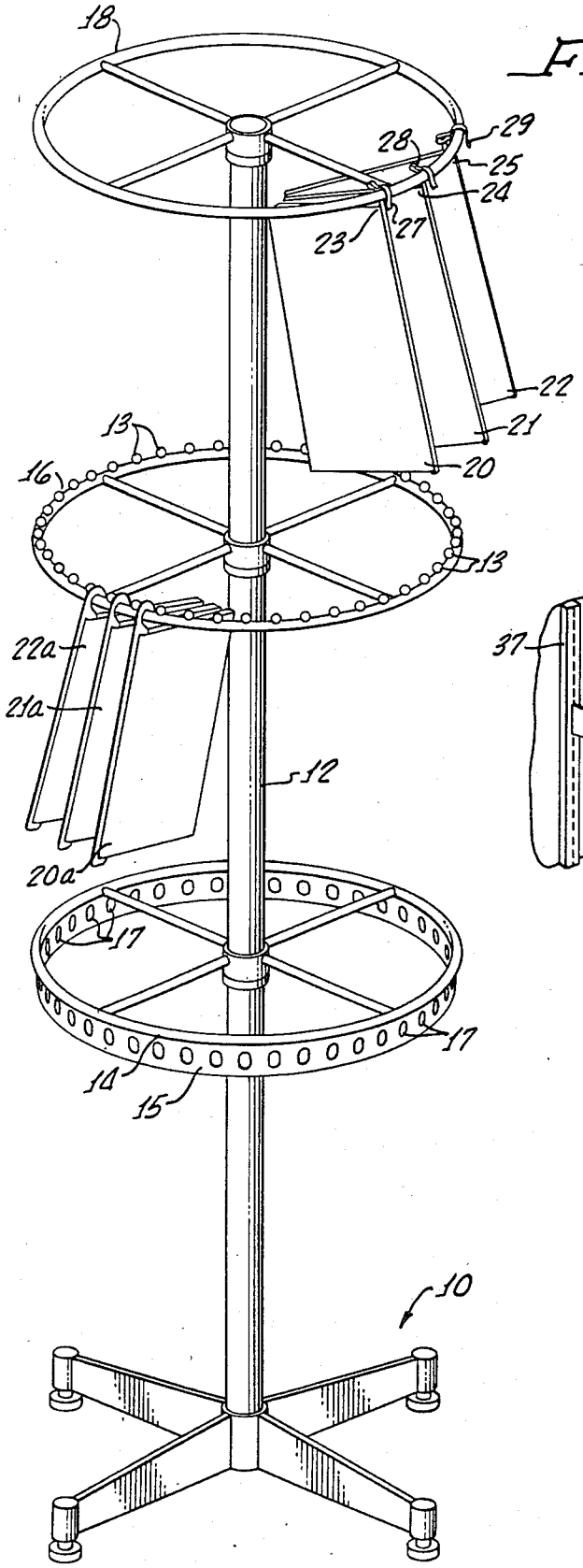
FIG. 1 illustrates a multi-tier circular support stand capable of hanging several closely packed groups of periodicals for ready access and display.

Illustrated in FIG. 1 is a multi-tiered storage and display stand comprising a base 10 carrying an upright post 12 upon which are rotatably mounted horizontally disposed skeletal storage and display rings 14, 16, and 18. This display stand is one of several support systems capable of use in storing and displaying a plurality of periodicals, which are illustrated at 20, 21, and 22 on ring 18 in FIG. 1. Each periodical is suspended at an upper rear corner, such as corners 23, 24, and 25, by means of hangers (to be described below) having backward pointing hooks 27, 28, and 29.

The relatively smooth surface of ring 18 allows variable spacing and sliding of the suspended periodicals. Alternatively, as shown for rings 14 and 16, the ring surface may be formed with a set of circumferentially spaced projections such as spheres 13 on ring 16 or have a fixed peripheral depending skirt 15 formed with apertures 17 for receiving hanger hooks. The spheres and apertured skirt enable more readily controllable uniform spacing of the periodicals. Periodicals 20*a*, 21*a*, and 22*a* are shown suspended from ring 16 on hangers having forward position hooks such as shown in FIGS. 26 and 28 to be described below.

Figure 2:
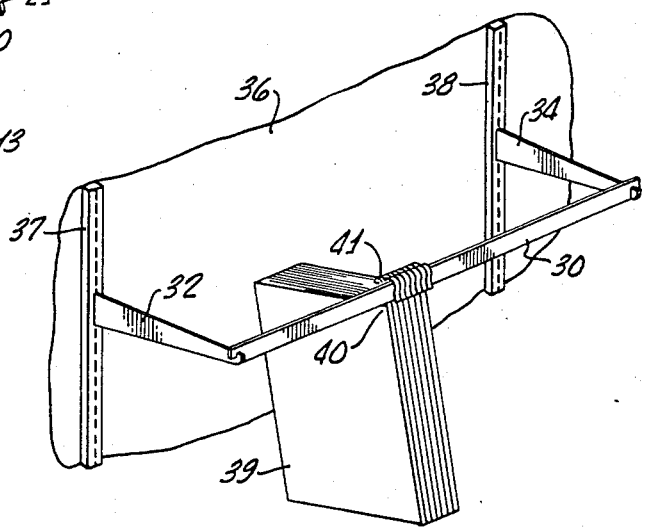
FIG. 2 illustrates an alternative form of support for hanging groups of periodicals.
Figure 3:
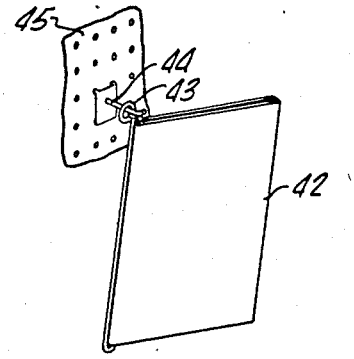
FIG. 3 illustrates yet another form of support for hanging a periodical.
Figure 20:
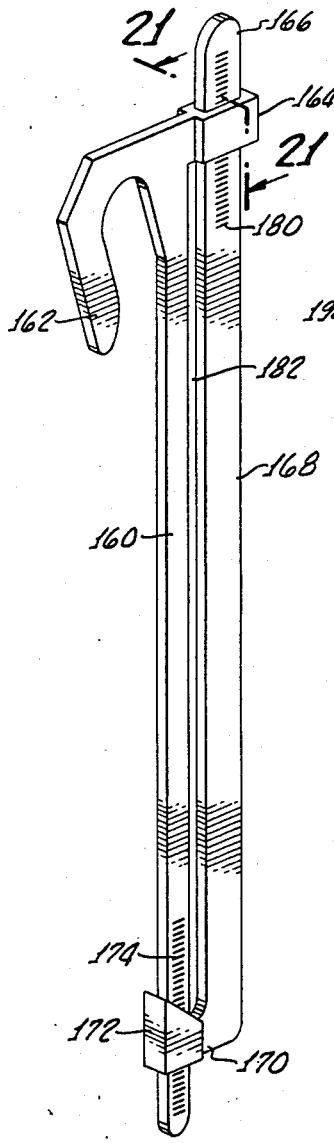
FIG. 20 shows an adjustable embodiment of the invention.

FIGS. 2 and 3 illustrate alternative arrangements for suspending periodicals employing the hanger system of the present invention. As shown in FIG. 2, a horizontally disposed, rigid support bar 30 is carried on support brackets 32, 34 fixed to a vertical support, such as a wall 36, for vertical adjustment on fixed adjustment rods 37, 38. Each of a group of periodicals, including periodical 39, is individually suspended from its uppermost rear corner 40 by means of a hanger of the present invention having a hook 41.

FIG. 3 shows a suspended periodical 42 secured in a hanger having a ringtype suspension support 43 which is engaged over an outwardly projecting, horizontally disposed rod 44 detachably and adjustably secured to the wall or other support 45.

It will be readily seen that a large number of periodicals, such as magazines, journals, or the like, may be suspended from the support bars 14, 16, 18, or support bar 30, with each magazine carried, as illustrated, at an upper rear edge in a generally vertically disposed orientation. The magazines can be tightly packed in side-by-side relation for maximum storage or loosely packed for visual access. Each tier or support ring of a stand of the type illustrated in FIG. 1, where the ring is approximately 20 inches in diameter, can store approximately 100 such magazines, so that a three tier stand requiring a minimum amount of floor space can store 300 magazines. Even when closely packed in side-by-side relation, individual periodicals may readily inserted into the stack or removed therefrom merely by disengaging the hanger hook from the support ring. Where the periodicals are to be suspended for display, a smaller number of periodicals will be suspended on each ring. The suspension of about 50 periodicals of average size on a 20 inch diameter support bar enables ready display of the covers of the magazines, enabling a reader to visually browse through the entire collection with one revolution of the support tier, removing or replacing individual periodicals with ease, or merely swinging some magazines aside with the touch of a finger to closely inspect the cover of another.

With periodicals suspended in a loosely packed arrangement, a portion of the periodical front and back covers of most or all is readily visible to the viewer, at a convenient reading angle, without disturbing or displacing any individual periodical. Nevertheless, with a group of such loosely filed periodicals, it is a simple matter for one browsing through the group to displace the hanging periodicals by slight finger touch so as to be able to easily see the entire cover of any given one without disengaging the hanger hook from the support rod. Each periodical may be pivoted outwardly about its pivotal suspension to the support rod, or a group of such periodicals may be pushed in a direction extending generally along a length of the support bar so as to increase the space between the cover of a selected periodical and another suspended periodical that is adjacent the selected cover. One inspecting the entire stack may readily rotate each ring, and thus sequentially and rapidly read the covers of each periodical. To obtain similar storage or display of a comparable number of periodicals employing conventional periodical storage and display systems requires up to 45 square feet of floor space, whereas the illustrated arrangement requires eight square feet of floor space. Cost of equipment for the display stand of FIG. 1 capable of displaying 150 magazines in loose file may be in the order of $300, whereas conventional wood or metal shelving units capable of storing and displaying a similar number of periodicals may cost as much as $2,400 or more.

A significant feature of the desired storage and display system is that each periodical, which is supported solely by a single hook or ring extending from a single corner of the periodical, is nevertheless fully and firmly, but detachably, confined and retained by the hanger that is connected to the hook.

Importantly, the periodical is merely supported by the hanger and is not damaged or modified in any manner. The described hangers merely clamp or support the periodical spine, in most embodiments, for the entire length of the spine. Because the hanger completely circumscribes the periodical spine (in most embodiments), the periodical is firmly, but detachably supported without any damage. Various types of such hangers are illustrated in FIGS. 4–28. It will be readily appreciated that many other variations on the concepts of the disclosed hanger embodiments are possible.

A presently preferred embodiment is illustrated in FIGS. 4, 5, 6, 10, and 11 which show a periodical hanger formed from a unitary strip of strong, thin, lightweight, and resilient material, such as steel, for example. A length of steel is bent to provide a first elongated hanger member or shaft 50 integrally connected to a second elongated hanger member or shaft 52 by means of a spine carrier element 54 extending from the lower end of the hanger member 50 to a lower portion of the hanger member 52. Hanger member 50 forms an elongated retaining strip. The upper end of hanger shaft 50 is bent to provide a spine retainer element in the form of a projecting flange 56 bent upon itself, as at 58, to provide an upper tongue 60 which extends outwardly of the hanger shaft 50 and downwardly thereof in an inward curve to provide an integral hook 62. Flange 56 is apertured, as at 64, to receive the upper end 66 of hanger shaft 52. Tongue 60 overlies the upper end 66 of shaft 56 and forms a protective cover for the edges of this end.

In use, the hanger shaft end 66 is removed from the aperture 64, as by resiliently bending upwardly retainer flange 56, 58 to release the end of hanger shaft 52 from the aperture. The hanger shaft 52 is inserted between the center pages of a periodical 70 (FIGS. 5, 6) to extend from bottom to top of the periodical closely adjacent the inside of the periodical spine. Hanger shaft 50 is pushed toward hanger shaft 52, which in its unstressed natural condition assumes the position illustrated in dotted lines in FIG. 4 wherein it extends outwardly of and at an angle to the hanger shaft 50. As hanger shaft 50 is pushed toward the other hanger shaft, flange 56 and tongue 60 are raised, either by the fingers of the operator or by camming action of the upper end 66 of shaft 52 against the curved bend 58, until the end of shaft 52 snaps into the aperture 64, whereupon the hanger is locked to and clamps the periodical spine, with the two hanger shafts urged toward each other. In this condition, as can also be seen in FIG. 6, both hanger shafts extend closely adjacent to the periodical spine throughout the entire length of the spine, from top to bottom. Resilience of the hanger material causes the hanger shafts to clasp the entire length of the spine between them for firm support. The narrow bent spine carrier element or saddle 54 at the lower end of hanger shaft 50, together with a lower portion of the hanger shaft 52, support the bottom of the spine of the periodical which may rest directly upon the spine carrier element. Depending upon the size and weight of the periodical and the relative strength and force of the clamping action of the hanger shafts, the periodical may still be firmly retained in the hanger with the bottom of its spine spaced slightly above the spine carrier element, if the clamping action of the hanger shafts is sufficient. Hanger shaft 50 is transversely curved in cross section, as best seen in FIG. 6, to better mate with the curved ("saddle stapled") or flat ("perfect bound") outside of the periodical spine.

In the manufacture of the hanger of FIGS. 4 and 5, a length of elongated material, such as resilient steel strap, is formed with lateral cuts 72, 74, as shown in FIG. 10, to allow the adjacent narrow portion 54 to be bent upon itself upwards, thereby forming a narrow U-shaped saddle or spine carrier element. The adjacent hanger part 52 is bent about its longitudinal axis to the position illustrated in FIG. 11 so that two longitudinally extending halves **52*a* and 52*b* of this hanger shaft are positioned in close face-to-face relation and extend in a direction generally perpendicular to the plane of the remainder of the elongated strip from which the hanger is formed. Thereafter, the remainder of the material may be bent to the illustrated configuration, bending the upper end of hanger shift 50 to form the spine retainer element described together with its latching aperture and integral hook. If deemed necessary or desirable, the hanger may be made adjustable to accept periodicals with spines of varying thickness by forming an upper flange 54*a* projecting from the top of a hanger shaft 50*b* with a plurality of apertures 64*a*, 64*b*, and 64*c*, as shown in FIG. 9**.

A modified version of the hanger of FIGS. 4, 5, and 6 is shown in FIGS. 7 and 8. In this version, the elements are substantially identical to those shown in FIGS. 4 and 5, differing only in that the hanger shaft **50*a* is outwardly bowed, being curved in a vertical plane away from the straight hanger shaft 52*a* so that resilience of the bowed hanger shaft will cause the periodical spine to be more tightly clamped between the two hanger members when the upper end of hanger shaft 52*a* is received in the latching aperture 64 of the hanger shaft 50*a***.

Illustrated in FIG. 12 is a modified version of the hanger, preferably made from strips of strong, rigid, but resilient, plastic. A first hanger shaft 76 has an integral, laterally projecting leg 78 at its bottom to which is fixedly secured a second hanger shaft 80 extending parallel to and for the full length of shaft 76. An enlarged head 82 on the upper end of hanger shaft 76 is formed with a hook 83 and a vertically extending, keyhole shaped slot 84 which receives an enlarged cylinder 86 fixed upon and projecting from an enlarged head 88 fixed to the upper end of shaft 80.

By outwardly bowing either hanger 76 or 80, latching cylinder 86 is able to slide out of the latching keyhole aperture 84, whereby the upper ends of the two hanger parts may be securely connected or disconnected. The lateral outward bowing of hanger shaft 76 is illustrated in FIG. 13.

The embodiment illustrated in FIG. 14 is substantially similar to that of FIGS. 12 and 13 in that hanger shafts 90 and 92 are fixed to one another at their lower edges to provide a carrier element 94 upon which may rest the bottom of the spine of a periodical captured between the hanger shafts 90 and 92. The two shafts are spaced from one another to define a spine receiving slot 96 and are formed with recesses **98*a*, 98*b*, and 98*c* spaced along the length of one of the shafts, which cooperate with protrusions 100*a*, 100*b*, and 100*c* on the other shaft to more firmly grasp the spine of a periodical clamped therebetween. The upper end of the hanger shaft 90 has an enlarged head 102 to which is affixed a hook 104 and has a vertically extending aperture that receives a tongue 106 that projects vertically upward from the upper end of hanger shaft 92. Lower edges of the periodical retaining slot 96 converge downwardly, as illustrated in FIG. 14**, to form a gravity pit at the bottom of the slot. This slot employs the periodical weight to wedge the bottom of the periodical spine into the tapering slot bottom and thereby provide additional anchorage for the spine in the hanger. The gravity pit is of particular benefit in securing the hanger to thin pamphlets or periodicals with relatively few pages.

As illustrated in FIG. 16, the hanger may be made of a single sheet of metal, plastic, cardboard, or the like, formed with a longitudinally extending periodical receiving slot 110 that separates a hanger shaft 112 from a hanger shaft 114. The slot is formed with a tapered lower end 116 to form a gravity pit, as previously described in connection with FIG. 14, and the wider upper end of the tapered hanger shaft 112 is formed with a suspension aperture 117 for use with a hook of the type such as shown in FIG. 3, for example.

The arrangement of FIG. 17 is substantially similar to that of FIG. 16 in that a hanger shaft 118 is integral with a hanger shaft 120 and separated therefrom by a periodical receiving slot 122 having a tapered gravity pit 124 at its lower edge. Hanger shaft 118 is of significantly increased width and is formed with an open bottom hook 126 for suspension of the hanger and a periodical placed therein. The extra width of hanger shaft 118 allows for the addition of printed material, such as advertising or periodical description, or the like, on its surface.

The embodiments of FIGS. 16 and 17 are used by first opening the periodical and then sliding one half of the open periodical through the slot until the periodical spine is positioned directly at the slot. Obviously, in these arrangements the slot must be of sufficient width to allow a significant number of pages of the periodical to be passed therethrough. A hanger of this configuration may exert little or no clamping action on the periodical spine. The use of the gravity pits 116 and 124 is of increased importance, because of the decrease or lack of the clamping action that is available with other embodiments such as those shown in FIGS. 4, 7, and 14.

The arrangement shown in FIGS. 18 and 19 is a modification of the protective book cover shown in my prior U.S. Pat. No. 4,128,262 for a magazine cover. FIG. 18 illustrates the outside or back of the cover which comprises an integral sheet having front and back cover sections 130, 132 interconnected by folded integral spine sections 134, 136, each of which is slotted to receive the pages of an opened periodical which may be slid through these slots to position the periodical's spine at the slots, as shown for periodical 138 in FIG. 19.

The cover spine sections 134, 136 are reinforced by a stiffening element 140 in the form of a hanger embodying principles of the present invention. Hanger 140 is made of a single integral sheet of metal, plastic, cardboard, or the like, and has a hanger shaft 142 separated from a hanger shaft 144 by a spine receiving slot 146 which is in registry with each of the slots in cover spine sections 134 and 136. The upper end of the reinforcing hanger 140 is formed with a suspension hook 150, and the entire reinforcing hanger is laminated to and between the cover spine sections 134 and 136 (by a suitable adhesive or the like), with all the slots in mutual registry so that the pages of a periodical may be passed through the slots with the front and back cover sections extending along and protecting the outside of the periodical. The bottom 148 of the hanger 140 forms a spine carrier element just as in the previous hangers, and the periodical, which is now covered as illustrated in FIG. 19, may be readily supported at its upper rear corner by the suspension hook 150.

Figure 21:
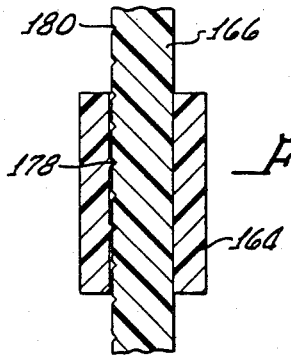
FIG. 21 is a section taken on lines 21—21 of FIG. 20.

FIGS. 20–23 illustrate various adjustable length versions of the hanger. In FIG. 21, a hanger shaft 160 has its upper end formed with a hook 162 and an enlarged head 164 having an aperture which receives the upper end 166 of a hanger shaft 168. The bottom of hanger shaft 168 is formed with a spine carrier element comprising a horizontally projecting leg 170 having an enlarged outer section 172 that is formed with a vertical aperture for slidably receiving the lower end 174 of the hanger shaft 160. The apertures in elements 164 and 170 are formed with a plurality of projections 178 (FIG. 21) that cooperate with shallow mating recesses 180 in the ends of the hanger parts. These cooperating projections and recesses provide a bidirectional resistance to relative sliding of the parts to obtain adjustment of the total length of the slot 182 formed between the hanger parts. Thus, the hanger is capable of being adjusted in height to snugly fit spines of periodicals of different sizes.

Figure 22:
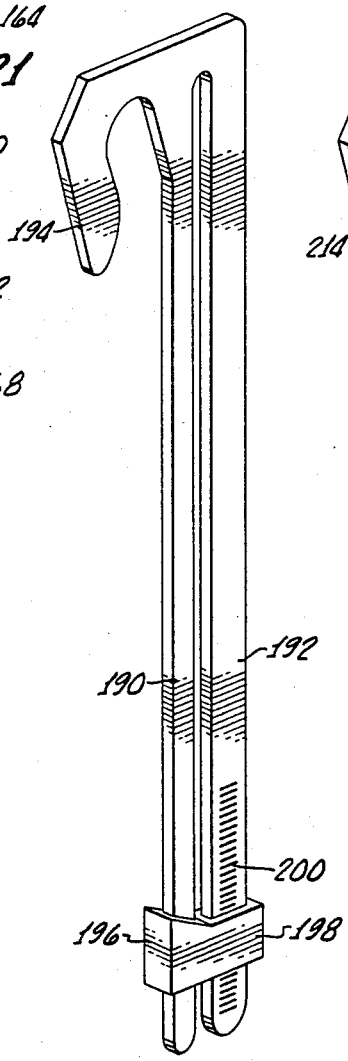
FIGS. 22 and 23 illustrate still other adjustable embodiments.

In the arrangement illustrated in FIG. 22, both the hanger shafts 190 and 192 are formed integrally, being joined at their upper ends and extended to form a suspension hook 194. To the lower end of one of the hanger parts, such as, for example, hanger part 190, is slidably mounted an enlarged bracket 196 having an outwardly extending leg 198 which is provided with a vertically extending aperture for slidable reception of the lower end portion 200 of hanger shaft 192. Interengaging slidable motion restraining projections and recesses of the type illustrated in FIG. 21 are also provided on the bottom of hanger shaft 192 and the recess in which it is received. Vertical adjustment of the length of the hanger of FIG. 22 is achieved merely by sliding the entire bracket 196 upwardly or downwardly along the length of both hanger parts.

Figure 23:
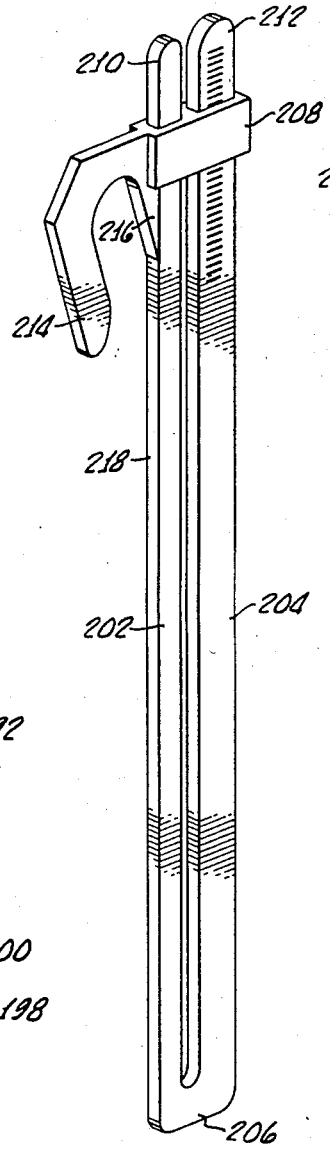

The version of the hanger shown in FIG. 23 is similar to that of FIG. 22, but in this case the two hanger shafts 202 and 204 are integral with each other and joined at their bottom, as at 206. A bracket 208 is formed with a pair of side-by-side, vertically extending apertures which slidably receive the upper end portions 210 and 212 of each of the hanger parts 202 and 204. A suspension hook 214 is fixed to the bracket 208 and includes a downwardly extending supporting element 216 which engages on and slides along the outer edge 218 of hanger shaft 202.

Figure 24:
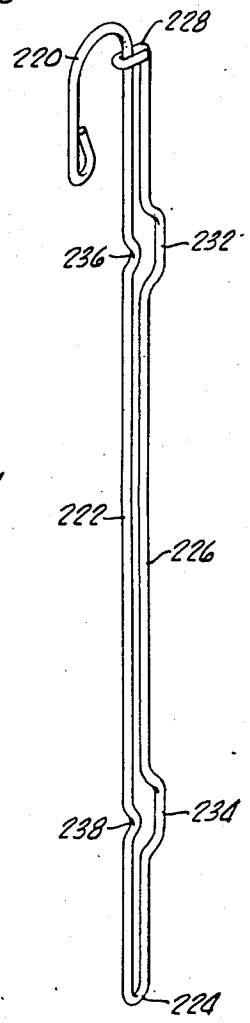
FIG. 24 shows a hanger made of bent rod.

FIG. 24 illustrates a version of the hanger formed of stiff and resilient rod or wire material. In this case, a single integral length of rod or wire is formed to provide a suspension hook 220 at an upper end of the hanger which extends downwardly to define a first hanger shaft 222. The wire is bent at the bottom of the hanger shaft, as at 224, to extend upwardly to form a second hanger shaft 226 of which the upper end is bent, as at 228, to form a hook-shaped latch that is C-shaped in a horizontal plane (assuming the hanger is oriented vertically) and which opens outwardly toward the right, as illustrated in FIG. 24, away from the hook 220. Thus, the C-shaped latching section 228 may be moved toward the hook 220 so as to engage or disengage hanger shaft 222 with or from the C-shaped latch 228. Gripping recesses 232, 234 are formed by outwardly bending spaced portions of hanger shaft 226. These gripping recesses cooperate with gripping projections 236, 238 formed on hanger shaft 222 at points which register with the recesses 232, 234. Bent wire sections 232, 234 forming the gripping recesses also perform a second function in that they are bent in the plane of hook 220 and in the plane containing both hanger shafts. This increases the extent of the hanger in the plane of the hook and in the plane of the periodical pages. This helps to prevent rotation of the hanger about the spine of the periodical which is captured between the hanger parts.

Figure 25:
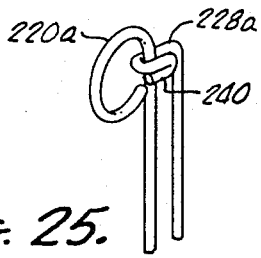
FIG. 25 is a detail showing a modification of a portion of the hanger of FIG. 24.

In the modification shown in FIG. 25, the hook 220 of FIG. 24 is changed to be a substantially complete ring 220*a*, and the latch portion 228 is slightly modified to provide a rebated section 240 thar provides greater protection for both ends of the wire. As can be seen in FIG. 25, both ends of the wire are positioned in close proximity to one another when the hanger parts are connected together.

The hanger embodiments of FIGS. 4, 7, and 31 (described below) are best adapted for use with periodicals which are covered by protective jackets in that either hanger shaft of each such embodiment, due to its comparative flatness, can be positioned either inside or outside a detachable paper or plastic cover of the periodical. For the other arrangements of hangers illustrated in the drawings, it is preferred to position one hanger shaft outside of any paper or plastic removable cover on the periodical.

Illustrated in FIG. 26 is an embodiment in which a suspension hook 250 of the hanger is pivoted to a hanger shaft 252 about a pivot 254 of which the axis extends perpendicular to the plane of hanger shaft 252, so that the hook 250 may swing downwardly toward the hanger shaft 252. A second hanger shaft 256 is integrally connected to the hanger shaft 252 at the bottom spine carrier element (which may be identical to element 206 of FIG. 23, for example) and extends upwardly to an end 262 that is received in a downwardly opening slot 260 in the underside of a laterally extending part of the hook 250. A finger 264 near the end of hanger shaft 256 is cammed into and out of a finger receiving aperture 266 in the hook to latch the pivoted hook in closed position.

In the arrangement of FIG. 26, the hook 250 may be pivoted downwardly to open the upper end of the slot 268 between the hanger shafts and allow insertion of the periodical spine.

In the arrangement shown in FIG. 27, a hanger is illustrated which is substantially identical to that of FIG. 16, but in which a major portion of the intermediate section of the second hanger shaft is omitted. Thus, the hanger of FIG. 27 includes a hanger shaft 270 having a ring (which may, of course, alternatively be a hook) 272 formed in an upper end thereof, and which has a spine carrier element 274 fixed to its lower end and comprising an outwardly horizontally extending leg 276 and a short, upwardly extending let 278. Similarly, a retainer element 280 at the upper portion of the hanger includes a horizontal leg 282 and a short, vertically downwardly extending leg 284. The upper end of the spine of the periodical is inserted in the slot between leg 284 and hanger shaft 270, whereas the lower end of the periodical spine is inserted into the slot between leg 278 and the lower end of hanger shaft 270. The spine of the periodical may be bowed slightly during the insertion and removal of the periodical into and from the hanger.

In FIG. 28 is shown a hanger having resilient hanger shafts 290, 292 integrally joined at a lower spine carrier section 294 and having an integral hook 296 at the upper end of shaft 290. Shaft 290 includes a spine retainer element 297 having an integral latching clip 298 which retains the upper end 300 of resilient hanger shaft 292. The latter may be caused to bow or engage or disengage it (much like a common safety pin) with or from the latching clip.

Preferably, the entire hanger of FIG. 28 is stamped from a single piece of metal or plastic. Latching clip 298 takes the shape of a latch tab **298*a* when the hanger is first stamped, as shown in FIG. 29. Then tab 298*a* is first bent outwardly and downwardly through 180° about an inclined axis 302 to extend along one side of hanger element 297 as shown in phantom lines in FIG. 29 and in solid lines in FIG. 30. The end 304 of the bent tab 298*a* is then bent laterally about a vertical axis 306 to extend around a forward end of and then laterally along and below the other side of the hanger element 297 to complete formation of the latching clip. In latched position, hanger parts 290 and 292 lie in the same plane with the upper edge of part 292 just below element 297**.

Figure 31:
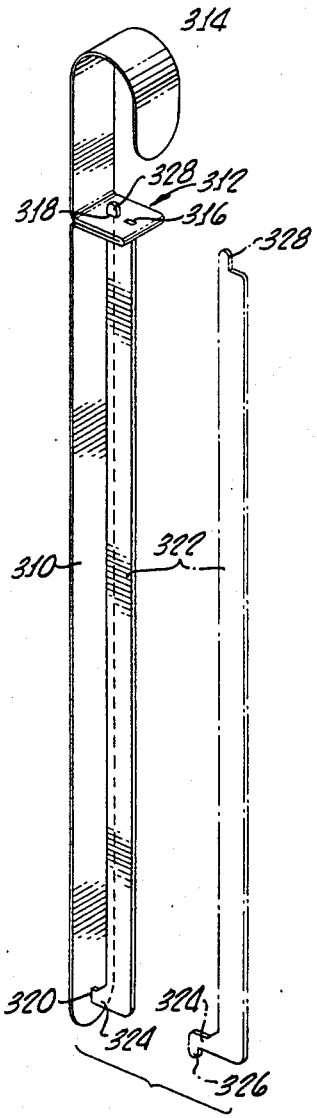
FIG. 31 illustrates a hanger similar to the hangers of FIGS. 4–8 but made in two detachable pieces.

Illustrated in FIG. 31 is a hanger embodying principles of the modifications previously described but made of two separable detachably connected parts. The first hanger part 310 is formed with a forwardly extending double-folded spine retainer element 312 which is bent upwardly to form the integral forwardly directed hook 314. The spine retainer element 312 is formed with a pair spaced apertures 316, 318. The lower end of the hanger 310 is formed with an aperture 320. A second hanger part 322, independent of the first part and substantially coextensive therewith, has a spine carrier element 324 projecting from its lower portion and having a downwardly extending tab 326 on its projecting end. The spine carrier element 324 is readily insertable into and retractable from the aperture 320 of hanger part 310, and when inserted in the aperture the tab 326 is hooked over the lower edge of the hanger part 310 that forms the bottom of aperture 320. At the upper end of hanger part 322 is formed a narrow vertically-upstanding finger 328 which can be inserted into and readily detached from either of the apertures 316, 318. In use, the two-part hanger of FIG. 31 may be completely assembled around the spine of a periodical, or the lower ends of the two hanger parts may be initially connected, as illustrated in the drawing, with the hanger part 322 extending along the spine between pages of the periodical and with hanger part 310 extending along outside of the spine. The overlying flange or spine retainer element 312 may be lifted by the operator's fingers so as to enable finger 328 to be inserted in one or the other of apertures 316, 318 to thereby completely secure the two-piece hanger about the periodical spine.

Figure 32:
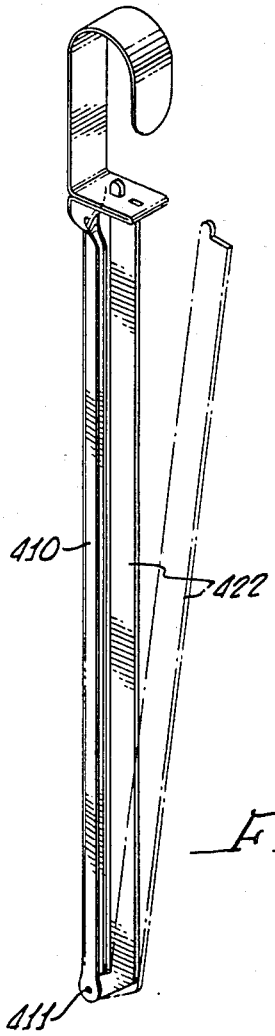
FIG. 32 shows a hanger having pivoted hanger parts.

The arrangement shown in FIG. 32 is basically similar to that shown in FIG. 31, except that its second hanger part 422 is pivotally connected to the first hanger part 410 on a pivot pin 411 carried at the bottom of hanger part 410. The structure, cross-sectional configuration and materials of the several hanger parts may be varied as previously described. It is found convenient for the manufacturer of the hinged arrangement shown in FIG. 32, to make the hanger part 410 of a longitudinally folded strip of metal or plastic with the two parts mutually spaced for reception of the lower end of the second hanger part 422 at the pivotal interconnetion 411. Thus, the pivot pin 411 extends through both of the mutually-spaced folded sides of hanger part 410 and through the lower end of hanger part 422 which is captured therebetween. In this arrangement, the hanger part 422 is detached at its upper end from hanger part 410 to allow one hanger part to be inserted into or removed from the pages of a periodical. The latching of the upper ends is the same as in the embodiment of FIG. 31.

Although the illustrated hanger embodiments are particularly adapted for and suited to use with periodicals, such as magazines, journals, pamphlets, and the like, it will be readily appreciated that versions with other dimensions or other materials and strengths may be readily adapted for suspension-type storage and display of quantities of hard cover or soft cover books. A significant feature of the illustrated hangers in all embodiments it the fact that the hanger will firmly grasp and firmly support a periodical, providing substantial support for the periodical at the bottom of its spine. Further, in all but one of the embodiments, the hanger provides full length support for the periodical spine along both inside and outside of the entire length of the spine. In several embodiments, the spine is not only supported at its bottom and for its full length, but is firmly gripped and clamped between inner and outer parts of the hanger. This firm grasping and securement of the periodical to the suspending hook enables the storage and display of a number of periodicals in either closely packed or loosely packed side-by-side relation. Where loosely packed, the entire cover, not just a portion of the cover as is the case with periodicals of conventional displays, is visible to the viewer.

The foregoing detailed description is to be clearly understood as given by way of illustration and example only, the spirit and scope of this invention being limited solely by the appended claims.

What is claimed is:

1. A hanger for periodicals, such as magazines, journals, and the like, having a spine, said spine having a top, a bottom, and inner and outer sides, said hanger comprising an elongated hanger member having first and second hanger member ends adapted to extend along one of said spine sides in close proximity to said spine, with said hanger member ends respectively adjacent said top and bottom of said spine, a spine carrier element connected to said hanger member at said second hanger member end, said spine carrier element having a first leg extending outwardly from said hanger member and adapted to extend beneath the bottom of said periodical spine to thereby support the periodical on said first leg, said spine carrier element having a second leg extending upwardly from an outer part of said first leg and adapted to extend along the other side of said spine to thereby retain the bottom of said spine upon said spine carrier element, a spine retainer element at said first hanger member end and extending downwardly therefrom, means for connecting said spine retainer element to said first hanger member end, said spine retainer element being adapted to extend along said other side of said spine to hold the top of said spine at said spine carrier, and suspension means on said hanger member at said first hanger member end for suspending said hanger and a periodical supported thereon from a single point, said second leg of said spine carrier element comprising an elongated retaining strip connected to said first leg of said spine carrier element and extending along said elongated hanger member for substantially the full length of said hanger member, said retaining strip having an upper end comprising a portion of said spine retainer element, said elongated hanger member having a closure member fixed to an upper end thereof and projecting outwardly therefrom, said closure member and the upper portion of said retaining strip collectively defining said spine retainer element, the upper end of said retaining strip being detachably connected to said closure member.

2. The apparatus of claim 1 wherein said closure member includes an aperture adapted to receive an end of said retaining strip for detachably interconnecting said retaining strip with said elongated hanger member.

3. The hanger of claim 2 wherein said suspension means comprises a hook connected with said closure member.

4. The apparatus of claim 2 wherein said elongated hanger member comprises a relatively wide, substantially flat ribbon of resilient material adapted to lie along the outside of the spine of a periodical, and wherein said retaining strip comprises a portion of said hanger member integral therewith and bent through 180° to extend substantially parallel to said hanger member, said retaining strip being bent about a longitudinal axis thereof to fold first and second longitudinally extending strip portions toward one another to decrease the dimension of said strip in a direction parallel to the width of said elongated hanger member, whereby said bent strip sections may be more readily inserted between the pages of a periodical.

5. The apparatus of claim 4 wherein said elongated hanger member has a curved cross section, thereby to enhance its resistance to bending.

6. The apparatus of claim 4 wherein said elongated hanger member is longitudinally curved, whereby said hanger member and retaining strip will resiliently clamp the spine of a periodical captured therebetween when said retaining strip is connected to said closure member, said elongated hanger member being formed of a resilient material.

7. A hanger for periodicals, such as magazines, journals, and the like, having a spine, said spine having a top, a bottom, and inner and outer sides, said hanger comprising an elongated hanger member having first and second hanger member ends adapted to extend along one of said spine sides in close proximity to said spine, with said hanger member ends respectively adjacent said top and bottom of said spine, a spine carrier element connected to said hanger member at said second hanger member end, said spine carrier element having a first leg extending outwardly from said hanger member and adapted to extend beneath the bottom of said periodical spine to thereby support the periodical on said first leg, said spine carrier element having a second leg extending upwardly from an outer part of said first leg and adapted to extend along the other side of said spine to thereby retain the bottom of said spine upon said spine carrier element, a spine retainer element at said first hanger member end and extending downwardly therefrom, means for connecting said spine retainer element to said first hanger member end, said spine retainer element being adapted to extend along said other side of said spine to hold the top of said spine at said spine carrier, and suspension means on said hanger member at said first hanger member end for suspending said hanger and a periodical supported thereon from a single point, said spine carrier and spine retainer elements are being formed of a second elongated hanger member extending substantially along the length of and proximate to said first mentioned elongated hanger member, said second hanger member being connected to said first mentioned hanger member at one end thereof and being detachably connected to said first mentioned hanger member at the other end thereof.

8. The apparatus of claim 7 including resilient latching means for detachably interconnecting said other end of said second hanger member to said first mentioned hanger member.

9. The apparatus of claim 7 wherein said spine retainer element is formed with a downwardly opening aperture, and wherein said second elongated hanger member is laterally flexible and has an upper end detachably receivable in said aperture to thereby detachably interconnect said elongated hanger members to one another.

10. The apparatus of claim 7 wherein both said elongated hanger members are formed of a single unitary flat material having a longitudinally extending slot therein extending substantially the full length of said hanger members, said slot being closed at upper and lower ends thereof.

11. The apparatus of claim 10 wherein said suspension means is integrally formed with said hanger members.

12. The apparatus of claim 8 wherein a portion of said spine retainer element is formed with a downwardly opening aperture, said second hanger member having an upper end slidably received in said aperture, said second hanger member having a bracket slidably mounted on its lower end, said bracket having an upwardly opening aperture for slidably receiving a lower end of said first mentioned hanger member, whereby said hanger is longitudinally adjustable for use with periodicals of different sizes, and including means for resisting sliding of said bracket relative to said hanger members.

13. The apparatus of claim 7 wherein said second hanger member is fixedly connected to said first mentioned hanger member at an upper portion thereof, and wherein said first leg of said spine carrier element has first and second upwardly opening apertures, the lower ends of said hanger members being received in said first and second apertures, respectively.

14. The apparatus of claim 7 wherein said hanger members are pivotally interconnected at the lower ends thereof, and wherein said spine retainer element is formed with first and second downwardly extending apertures, the upper end of said second elongated hanger member being detachably received in one of said first and second apertures.

15. The apparatus of claim 7 wherein said elongated hanger members are integrally formed from a single length of bent rod, and including a latch secured to the upper end of one of said hanger members for detachably connecting upper ends of said hanger members to one another.

16. The apparatus of claim 7 wherein said second elongated hanger member is formed with a recess opening toward said first mentioned hanger member, and wherein said first mentioned hanger member is formed with a projection extending toward and aligned with said recess, whereby said projection and recess may cooperate to clamp therebetween the spine of a periodical carried by the hanger.

17. A hanger for periodicals, such as magazines, journals, or the like, having a spine, said hanger comprising first and second elongated hanger members extending in close proximity to and alongside of one another, said hanger members being spaced apart and adapted to confine a periodical spine extending between them, said members having upper and lower ends adapted to be respectively positioned above and below upper and lower ends of a periodical spine confined between the members, the ends of said first hanger member being connected to the corresponding ends of said second hanger member, whereby said connected hanger members circumscribe said periodical spine and thereby carry said periodical, and suspension means carried by one of said hanger members at its upper end for suspending said hanger members and a periodical carried thereby, said first and second hanger members being movably connected to one another at one end and detachably connected to one another at the other end, whereby said other ends of said hanger members may be disconnected from one another to insert one of said elongated hanger members between the pages of a periodical along the spine thereof with the other of said hanger members extending outside of said periodical along the spine thereof, so that when said other ends are connected to one another said periodical is captured between and supported by said interconnected hanger members.

18. The hanger of claim 17 including a latch on the upper end of said one hanger member for detachably retaining the upper end of the other of said hanger members, said hanger members, suspension means and latch all being stamped out of a single piece of material to form a blank having said hanger members and a latch tab projecting from the upper end of said one hanger member, said latch tab being downwardly and outwardly to extend along one side of said one hanger member and having an end bent laterally to extend along and below the other side of said one hanger member.

19. The hanger of claim 17 wherein said first and second elongated hanger members are formed of a single piece of elongated material having a longitudinally extending slot therein, said slot separating and defining said first hanger members, said slot being closed at its ends, and said suspension means being formed integrally with said elongated material.

20. The apparatus of claim 17 wherein said hanger members define a periodical receiving slot therebetween, said slot being downwardly tapered at a lower end thereof for enhancing securement of relatively thin periodicals.

21. A hanger for periodicals, such as magazines, journals, or the like, having a spine, said hanger comprising first and second elongated hanger members extending in close proximity to and alongside of one another, said hanger members being spaced apart and adapted to confine a periodical spine extending between them, said members having upper and lower ends adapted to be respectively positioned above and below upper and lower ends of a periodical spine confined between the members, the ends of said first hanger member connected to the corresponding ends of the said second hanger member, whereby said connected hanger members circumscribe said periodical spine and thereby carry said periodical, and suspension means carried by one of said hanger members at its upper end for suspending said hanger members and a periodical carried thereby, said first and second hanger members being detachably connected to each other at one end.

22. The hanger of claim 21 wherein one end of said first hanger member is formed with an aperture, and wherein the corresponding end of said second hanger member is formed with an extension that is removably received in said aperture.

23. The hanger of claim 17 wherein ends of said first and second hanger members that are remote from said suspension means are pivotally interconnected.

24. A hanger for periodicals, such as magazines, journals, or the like, having a relatively stiff self-supporting spine, said hanger comprising first and second elongated hanger members extending in close proximity to and alongside of one another, said hanger members being spaced apart and adapted to confine and extend along a major part of the length of a periodical spine extending between them, means connected to said members for holding them adjacent each other to clamp a periodical spine confined between the members, and suspension means carried by one of said hanger members at an upper end thereof for suspending said hanger members and a periodical of which the spine is clamped thereby.

25. The hanger of claim 24 wherein said hanger members are pivoted to one another at a lower end of each, and including means at an upper end of at least one of said hanger members for detachably connecting it to the other.

26. The hanger of claim 25 wherein said hanger members each has a length greater than the length of the spine of a periodical that is adapted to be confined therebetween, and wherein said means for detachably connecting comprises a resiliently displaceable spine retainer element on said first hanger member and interengaging means on said retaining element and said second hanger member.

27. A periodical display comprising an elongated, substantially horizontally disposed support bar, a plurality of periodicals, each having a relatively stiff self-supporting spine, and hanger means, including a plurality of hanger devices, for suspending each said periodical from a single suspension point on said bar in substantially mutually disposed side-by-side relation with respect to adjacent periodicals, each said device comprising a hanger of the kind set forth in any one of claims 2, 19, 24, and 26.

28. The periodical display of claim 27 wherein said suspension means comprises a hook fixed to one of said hanger members and pivotally engaged with and supported by said support bar, whereby an individual periodical may be swung outwardly of adjacent periodicals to facilitate visual access.

29. The method of storing a number of periodicals for ready visual acces and display comprising positioning an elongated hanger member along the spine of each periodical, positioning a spine carrier below the bottom of the spine of each periodical and securing the spine carrier to the hanger member to prevent the periodical from falling from the hanger member, positioning a spine retainer above the top of the spine of each periodical and securing the spine retainer to the hanger member to restrain displacement of the upper part of the periodical from the top of the hanger member, providing an elongated, substantially horizontally disposed support bar, and suspending each of a group of said periodicals in substantially vertically disposed orientation adjacent similarly disposed periodicals on either side thereof by hooking a part of the hanger member at the top of such periodical over said support bar.

30. A periodical display comprising an elongated, substantially horizontally disposed support, a plurality of periodicals, each having a relatively stiff self-supporting spine, and hanger means, including a plurality of hanger devices, for suspending each said periodical from said support at a single suspension point in substantially mutually disposed side-by-side relation with respect to adjacent periodicals, each said device comprising a hanger of the kind set forth in claim 21.

* * * * *

UNITED STATES PATENT AND TRADEMARK OFFICE

CERTIFICATE OF CORRECTION

PATENT NO. : 4,681,232

DATED : July 21, 1987

INVENTOR(S) : Gerard M. Du Corday

It is certified that error appears in the above-identified patent and that said Letters Patent is hereby corrected as shown below:

Claim 7 (column 12, line 44), delete "are".

Claim 21 (column 14, line 42), following "member" insert —being—.

Signed and Sealed this

Nineteenth Day of January, 1988

*Attest:*

DONALD J. QUIGG

*Attesting Officer*

*Commissioner of Patents and Trademarks*